US010504391B2

(12) United States Patent
Lim et al.

(10) Patent No.: US 10,504,391 B2
(45) Date of Patent: Dec. 10, 2019

(54) DATA DRIVER AND DISPLAY DEVICE USING THE SAME

(71) Applicant: LG Display Co., Ltd., Seoul (KR)

(72) Inventors: Myunggi Lim, Ansan-si (KR); Kyoungdon Woo, Paju-si (KR); Seokhyun Hong, Suwon-si (KR); Hyuckjun Kim, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 143 days.

(21) Appl. No.: 15/786,050

(22) Filed: Oct. 17, 2017

(65) Prior Publication Data

US 2018/0122364 A1 May 3, 2018

(30) Foreign Application Priority Data

Oct. 31, 2016 (KR) ..... 10-2016-0143997

(51) Int. Cl.

| | |
|---|---|
| ***G09G 3/3291*** | (2016.01) |
| ***G09G 3/3233*** | (2016.01) |
| ***G09G 3/3275*** | (2016.01) |
| ***G09G 3/00*** | (2006.01) |
| ***G09G 3/20*** | (2006.01) |
| ***G09G 3/3225*** | (2016.01) |

(52) U.S. Cl.

CPC ..... *G09G 3/00* (2013.01); *G09G 3/2096* (2013.01); *G09G 3/3225* (2013.01); *G09G 3/3291* (2013.01); *G09G 2310/0289* (2013.01)

(58) Field of Classification Search

CPC ..... G09G 3/00; G09G 3/3291; G09G 3/3225; G09G 3/2096; G09G 2310/0289

See application file for complete search history.

(56) References Cited

U.S. PATENT DOCUMENTS

| | | | | |
|---|---|---|---|---|
| 2014/0176622 | A1* | 6/2014 | Jung | G09G 3/3208 345/690 |
| 2015/0294626 | A1* | 10/2015 | Bi | G09G 3/3233 345/211 |
| 2016/0155380 | A1* | 6/2016 | Kwon | G09G 3/3233 345/78 |
| 2017/0032738 | A1* | 2/2017 | Lee | G09G 3/3233 |
| 2017/0084227 | A1* | 3/2017 | Bae | G09G 3/3275 |
| 2017/0168615 | A1* | 6/2017 | Huang | G09G 3/3688 |

OTHER PUBLICATIONS

British Combined Search and Examination Report, Intellectual Property Office Patent Application No. GB1717936.7, dated Jun. 13, 2018, five pages.

* cited by examiner

*Primary Examiner* — Lixi C Simpson
(74) *Attorney, Agent, or Firm* — Fenwick & West LLP

(57) ABSTRACT

A display device comprises a display panel that displays an image and has a data line and a sensing line, a data driver that drives the display panel, and a power supply part that delivers a driving reference voltage through a wiring line connected to the data driver. The data driver supplies a data signal to the data line, supplies the driving reference voltage through the sensing line, senses the sensing line based on an internally generated sensing reference voltage, and integrates a sensing result.

11 Claims, 18 Drawing Sheets

(a)

(b)

(a)

(b)

(a)

(b)

DATA DRIVER AND DISPLAY DEVICE USING THE SAME

This application claims the priority benefit of Korean Patent Application No. 10-2016-0143997 filed on Oct. 31, 2016, which is hereby incorporated herein by reference for all purposes as if fully set forth herein.

BACKGROUND

Field

The present disclosure relates to a data driver and a display device using the same.

Description of the Related Art

The market for displays which act as an intermediary between users and information is growing with the development of information technology. Thus, display devices such as organic light-emitting displays (OLEDs), liquid crystal displays (LCDs), and plasma display panels (PDPs) are increasingly used.

An organic light-emitting display comprises a display panel comprising a plurality of subpixels and a drive part that drives the display panel. The drive part comprises a scan driver that supplies scan signals (or gate signals) to the display panel and a data driver that supplies data signals to the display panel. When a scan signal, a data signal, etc. are supplied to the subpixels on the organic light-emitting display, selected subpixels emit light, thereby displaying an image.

On the display panel, the subpixels are implemented based on devices, such as thin-film transistors that are formed on a substrate by deposition. Due to differences in intrinsic characteristics such as threshold voltage, devices such as thin-film transistors require compensation even in an initial stage in order to exhibit uniform brightness characteristics, and they degrade when driven for a long time, like a threshold voltage shift or a decrease in lifetime. When device degradation occurs, the brightness characteristics of the display panel which displays images based on these devices change.

In a conventionally proposed compensation method, a reference voltage of a particular level is applied to a sensing line during a display period of the display panel to compensate for device characteristics, and the sensing line is sensed during a sensing period of the display panel to compensate for device characteristics or adjust brightness level. However, the conventionally proposed method can cause a reduction in sensing accuracy due to noise, so a solution to this is needed.

SUMMARY

One or more embodiments of the present disclosure provides a display device comprising: a display panel that displays an image and has a data line and a sensing line; a data driver that drives the display panel; and a power supply part that delivers a driving reference voltage through a wiring line connected to the data driver, wherein the data driver supplies a data signal to the data line, supplies the driving reference voltage through the sensing line, senses the sensing line based on an internally generated sensing reference voltage, and integrates a sensing result.

In another aspect, one or more embodiments of the present disclosure provides a data driver comprising: an integration circuit part that applies an externally supplied driving reference voltage to an external sensing line and senses the external sensing line based on an internally generated sensing reference voltage, and integrates a sensing result; and an offset correction part that corrects for variations in the sensing reference voltage, along with the integration circuit part, by using the driving reference voltage as a reference.

BRIEF DESCRIPTION OF THE DRAWINGS

The accompanying drawings, which are included to provide a further understanding of the disclosure and are incorporated in and constitute a part of this specification, illustrate embodiments of the disclosure and together with the description serve to explain the principles of the disclosure.

DETAILED DESCRIPTION OF PREFERRED EMBODIMENTS

Reference will now be made in detail to embodiments of the disclosure, examples of which are illustrated in the accompanying drawings.

A display device according to the present disclosure is implemented as a television, a video player, a personal computer (PC), a home theater, a smartphone, etc. An organic light-emitting display will be given as an example of the display device according to the present disclosure. However, this is merely for illustration, and other types of display devices may be applicable as long as they can perform compensations using reference voltages.

Moreover, a thin-film transistor to be described below may be referred to as a source electrode and a drain electrode or as a drain electrode and a source electrode depending on the type, but without a gate electrode. Thus, the thin-film transistor will be described as a first electrode and a second electrode so that it is not limited by such terms.

Figure 1:
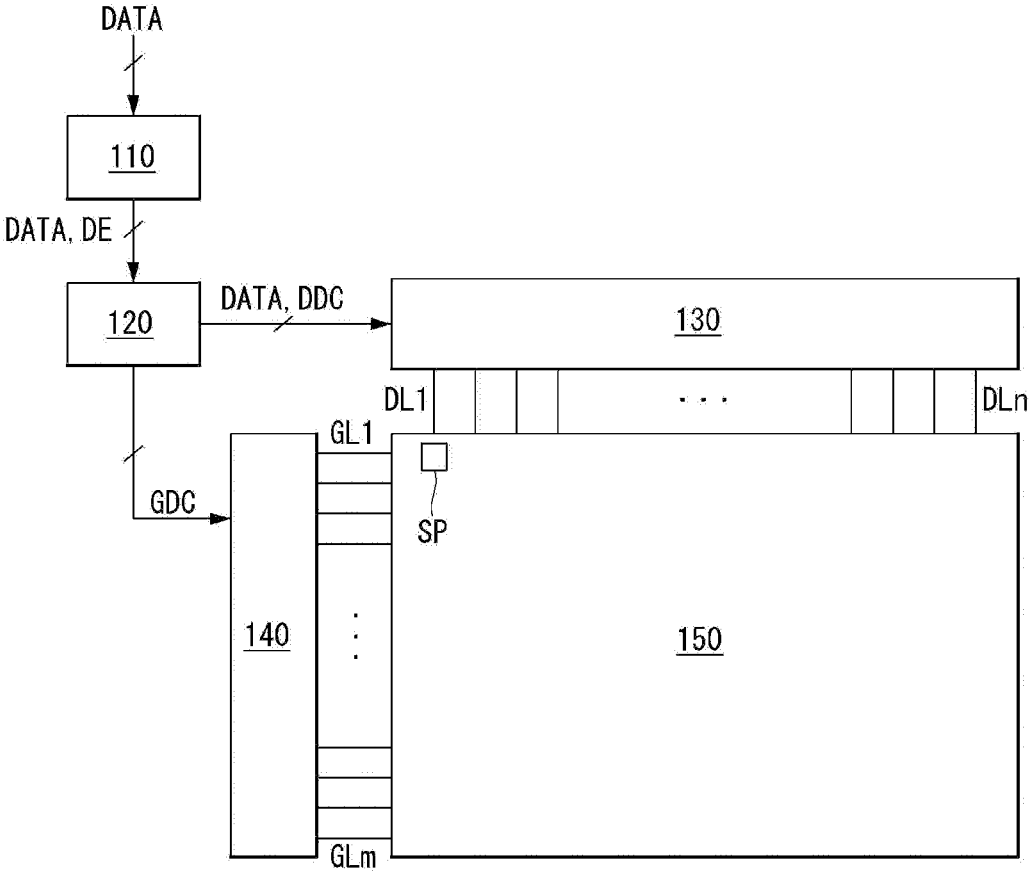
FIG. 1 is a schematic block diagram of an organic light-emitting display according to an exemplary embodiment of the present disclosure.
Figure 2:
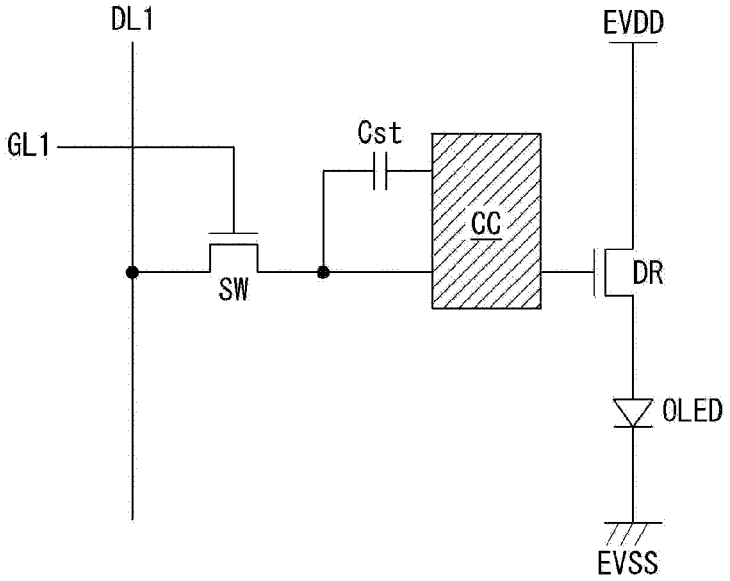
FIG. 2 is a schematic circuit diagram of a subpixel.
Figure 3:
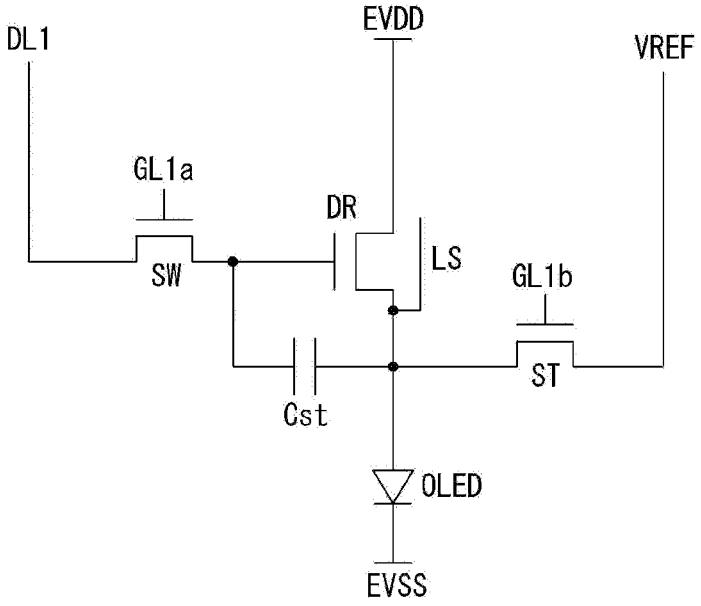
FIG. 3 is a detailed circuit diagram of a subpixel according to an exemplary embodiment of the present disclosure.
Figure 4:
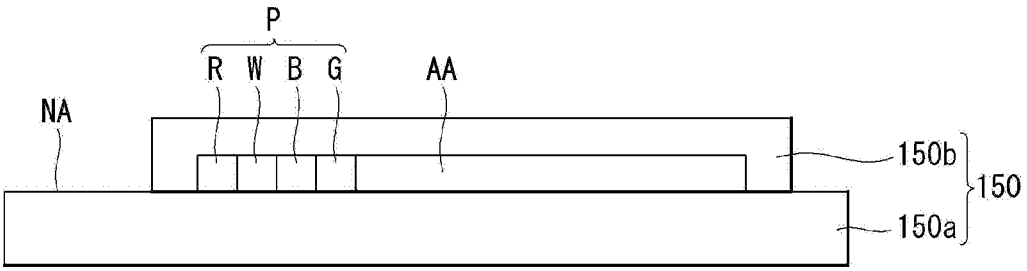
FIG. 4 is an illustration of a cross-section of a display panel according to an exemplary embodiment of the present disclosure.
Figure 5:
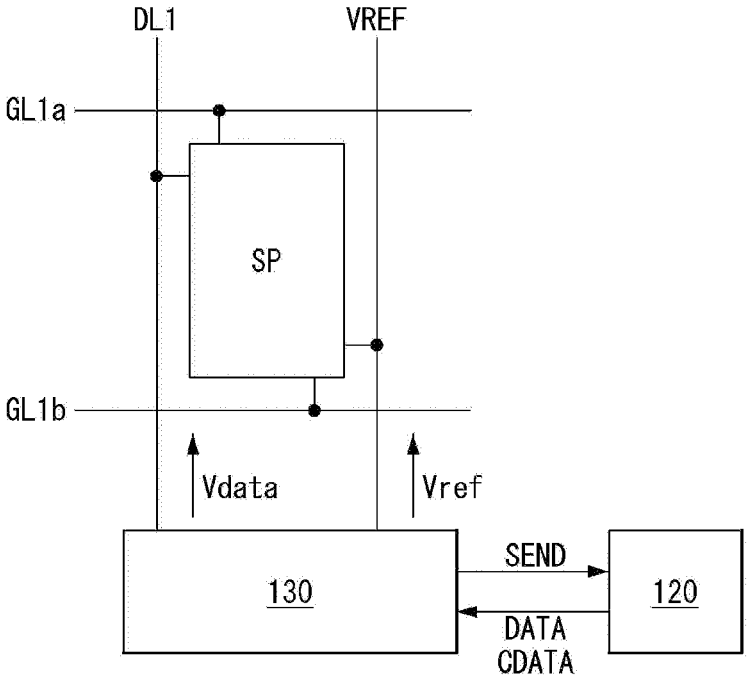
FIG. 5 is a block diagram for explaining a compensation method according to an exemplary embodiment of the present disclosure.

FIG. 1 is a schematic block diagram of an organic light-emitting display according to an exemplary embodiment of the present disclosure. FIG. 2 is a schematic circuit diagram of a subpixel. FIG. 3 is a detailed circuit diagram of a subpixel according to an exemplary embodiment of the present disclosure. FIG. 4 is an illustration of a cross-section of a display panel according to an exemplary embodiment of the present disclosure. FIG. 5 is a block diagram illustrating a compensation method according to an exemplary embodiment of the present disclosure.

As illustrated in FIG. 1, an organic light-emitting display according to an exemplary embodiment of the present disclosure comprises an image processor 110, a timing controller 120, a data driver 130, a scan driver 140, and a display panel 150.

The image processor 110 outputs a data enable signal DE, etc., along with an externally supplied data signal DATA. In addition to the data enable signal DE, the image processor 110 may output one or more among a vertical synchronization signal, a horizontal synchronization signal, and a clock signal. But, these signals will be omitted in the drawings for convenience of explanation.

The timing controller 120 receives the data signal DATA from the image processor 110, along with the data enable signal DE or driving signals including the vertical synchronization signal, horizontal synchronization signal, and clock signal. The timing controller 120 outputs a gate timing control signal GDC for controlling the operation timing of the scan driver 140 and a data timing control signal DDC for controlling the operation timing of the data driver 130, based on the driving signals.

The data driver 130 samples and latches the data signal DATA supplied from the timing controller 120, in response to the data timing control signal DDC supplied from the timing controller 120. The data driver 130 converts digital data signal DATA to an analog data signal and outputs it, in conjunction with an internal or external programmable gamma part. The data driver 130 outputs data signals DATA through data lines DL1 to DLn. The data driver 130 may be provided in the form of an IC (integrated circuit).

The scan driver 140 outputs a scan signal in response to the gate timing control signal GDC supplied from the timing controller 120. The scan driver 140 outputs scan signals through scan lines GL1 to GLm. The scan driver 140 is provided in the form of an IC (integrated circuit), or provided on the display panel 150 in the form of a gate-in-panel.

The display panel 150 displays an image in response to the data signals DATA and scan signals respectively supplied from the data driver 130 and scan driver 140. The display panel 150 comprises subpixels SP that work to display an image.

The subpixels are formed by a top-emission scheme, bottom-emission scheme, or dual-emission scheme depending on the structure. The subpixels SP may comprise red subpixels, green subpixels, and blue subpixels, or may comprise white subpixels, red subpixels, green subpixels, and blue subpixels. The subpixels SP may have one or more different light-emission areas depending on the light-emission characteristics. The subpixels SP may produce white, red, green, and blue based on a white organic-emitting layer and red, green, and blue color filters, but are not limited thereto.

As illustrated in FIG. 2, one subpixel comprises a switching transistor SW, a driving transistor DR, a storage capacitor Cst, a compensation circuit CC, and an organic light-emitting diode OLED.

The switching transistor SW acts as a switch in response to a scan signal supplied through the first scan line GL1 to store a data signal supplied through the first data line DL1 as a data voltage in the storage capacitor Cst. The driving transistor DR works to cause a drive current to flow between a first power supply line EVDD and a second power supply line EVSS by the data voltage stored in the storage capacitor Cst. The organic light-emitting diode OLED works to emit light by the drive current formed by the driving transistor DR.

The compensation circuit CC is a circuit that is added within the subpixel to compensate for a threshold voltage, etc. of the driving transistor DR. The compensation circuit CC consists of one or more transistors. The configuration of the compensation circuit CC varies widely depending on the method of compensation, and an example thereof will be described below.

As illustrated in FIG. 3, the compensation circuit CC comprises a sensing transistor ST and a sensing line VREF. The sensing transistor ST is connected between a source line of the driving transistor DR and an anode (hereinafter, "sensing node") of the organic light-emitting diode OLED. The sensing transistor ST may operate to supply a reference voltage (or sensing voltage) delivered through the sensing line VREF to the sensing node or sense the voltage or current in the sensing node.

The switching transistor SW has a first electrode connected to a first data line DL1 and a second electrode connected to a gate electrode of the driving transistor DR. The driving transistor DR has a first electrode connected to the first power supply line EVDD and a second electrode connected to the anode of the organic light-emitting diode OLED. The storage capacitor Cst has a first electrode connected to the gate electrode of the driving transistor DR and a second electrode connected to the anode of the organic light-emitting diode OLED. The organic light-emitting diode OLED has the anode connected to the second electrode of the driving transistor DR and a cathode connected to the second power supply line EVSS. The sensing transistor ST has a first electrode connected to the sensing line VREF and a second electrode connected to the anode of the organic light-emitting diode OLED that is a sensing node.

The operating time of the sensing transistor ST may be similar/equal to that of the switching transistor SW or different from it, depending on the compensation algorithm (or the compensation circuit configuration). The switching transistor SW may have a gate electrode connected to a 1a scan line GL1*a*, and the sensing transistor ST may have a gate electrode connected to a 1b scan line GL1*b*. In another example, the 1a scan line GL1*a* connected to the gate electrode of the switching transistor SW and the 1b scan line GL1*b* connected to the gate electrode of the sensing transistor ST may be connected so as to be shared in common.

A light blocking layer LS is provided to block ambient light. The light blocking layer LS may cause the problem of parasitic voltage charging when formed from a metallic material. Due to this, the light blocking layer LS may be disposed only below a channel region of the driving transistor DR, or may be disposed below channel regions of the switching transistor SW and sensing transistor ST as well. Meanwhile, the light blocking layer LS may be used simply for the purpose of blocking ambient light, or the light blocking layer LS may be used as an electrode that facilitates a connection with other electrodes or lines and forms a capacitor, etc.

Targets to be compensated for according to a sensing result may include a digital data signal, an analog data signal, or a gamma voltage. The compensation circuit, which generates a compensated signal (or compensated voltage) based on the sensing result, may be implemented as an internal circuit of the data driver, as an internal circuit of the timing controller, or as a separate circuit.

FIG. 3 illustrates, by way of example, a subpixel having a 3-transistors/1-capacitor structure comprising the switching transistor SW, the driving transistor DR, the storage capacitor Cst, the organic light-emitting diode OLED, and the sensing transistor ST. However, when a compensation circuit CC is added, the subpixel may be configured to have a 3T2C, 4T2C, 5T1C, or 6T2C structure.

As illustrated in FIG. 4, subpixels are formed in a display area AA of a first substrate 150*a*, based on the circuit explained with reference to FIG. 3. The subpixels formed in the display area AA are sealed by a protective film (or a protective substrate) 150*b*. The unexplained part NA refers to a non-display area.

The subpixels may be horizontally or vertically arranged in the display area AA, for example, in order of red (R), white (W), blue (B), and green (G) colors. The red, white, blue, and green subpixels R, W, B, and G may form a single pixel P. However, the sequence of the subpixels may be altered in various ways depending on emitting materials, light-emission areas, the compensation circuit configuration (or structure), and so on. Also, the red, blue, and green subpixels R, B, and G may form a single pixel P.

On the above-described display panel, the subpixels are implemented based on devices, such as thin-film transistors that are formed on a substrate by deposition. Devices such as thin-film transistors degrade when driven for a long time, like a threshold voltage shift or a decrease in lifetime. When device degradation occurs, the brightness characteristics of the display panel which displays images based on these devices change.

The organic light-emitting display according to the present disclosure is configured as in the following FIG. 5 so as to perform compensations such as compensating for device characteristics or adjusting brightness level.

As illustrated in FIG. 5, the data driver 130 is connected to a data line DL1 and sensing line VREF for a subpixel SP. The data driver 130 supplies a data voltage Vdata (or data signal) through the data line DL1 and supplies a reference voltage Vref through the sensing line VREF.

The data driver 130 outputs a data voltage Vdata based on a data signal DATA output from the timing controller 120. Also, the data driver 130 delivers a sensing result SEND obtained through the sensing line VREF to the timing controller 120, and outputs a data voltage Vdata based on a compensated data signal CDATA output from the timing controller 120. The data driver 130 may sense the sensing node of the subpixel over a real-time period (including a display period, a sensing period, and a non-display period), during a sensing period, during an image non-display period, or during an N frame (N is an integer of 1 or greater), and generate a sensing result SEND.

The data driver 130 applies a driving reference voltage of a particular level to a sensing line during a display period of the display panel, and senses the sensing line during a sensing period of the display panel to perform a compensation operation for compensating for device characteristics or adjusting brightness level.

The data driver 130 applies an externally supplied driving reference voltage to a sensing line. Also, the data driver 130 senses and samples the voltage or current across the sensing line based on an externally supplied sensing reference voltage. In this way, when a driving reference voltage and a sensing reference voltage are externally supplied, these voltages are affected by noise, resulting in a reduction in sensing accuracy. Thus, a solution to this is needed.

Hereinafter, a test example and exemplary embodiments of the present disclosure for solving problems with the test example will be described.

Test Example

Figure 6:
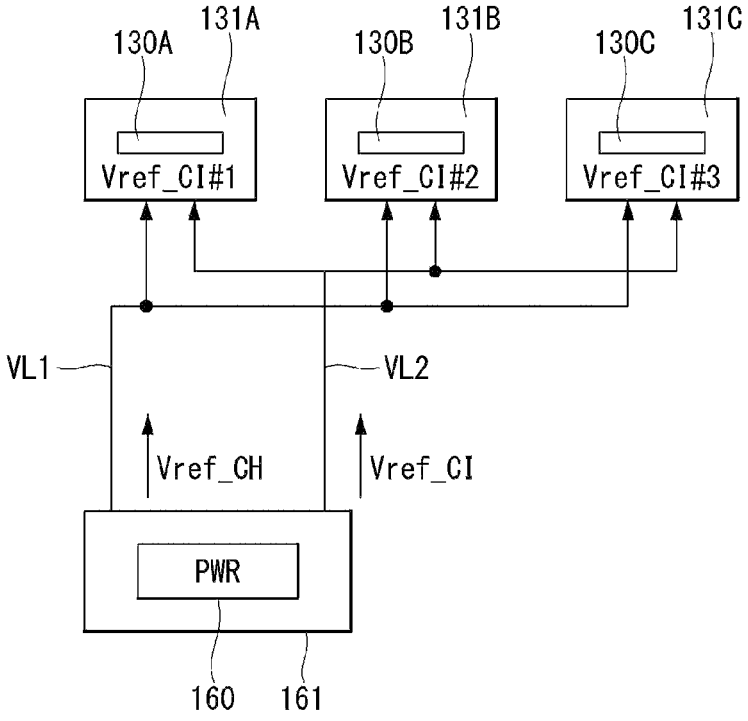
FIG. 6 is a view showing how data drivers and a power supply part are configured according to a test example.
Figure 7:
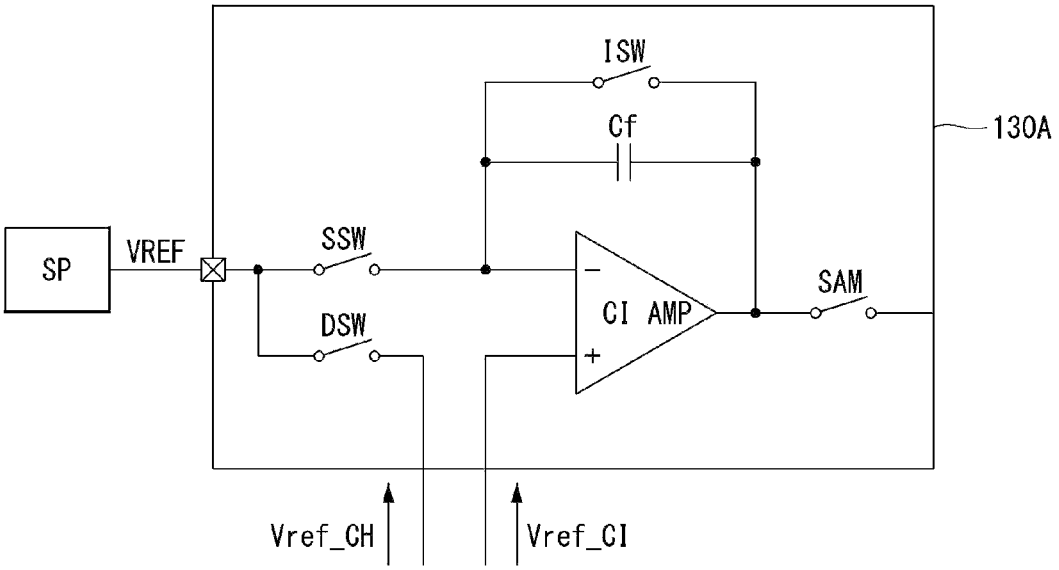
FIG. 7 is a view showing some of the components included in a first data driver.
Figure 8:
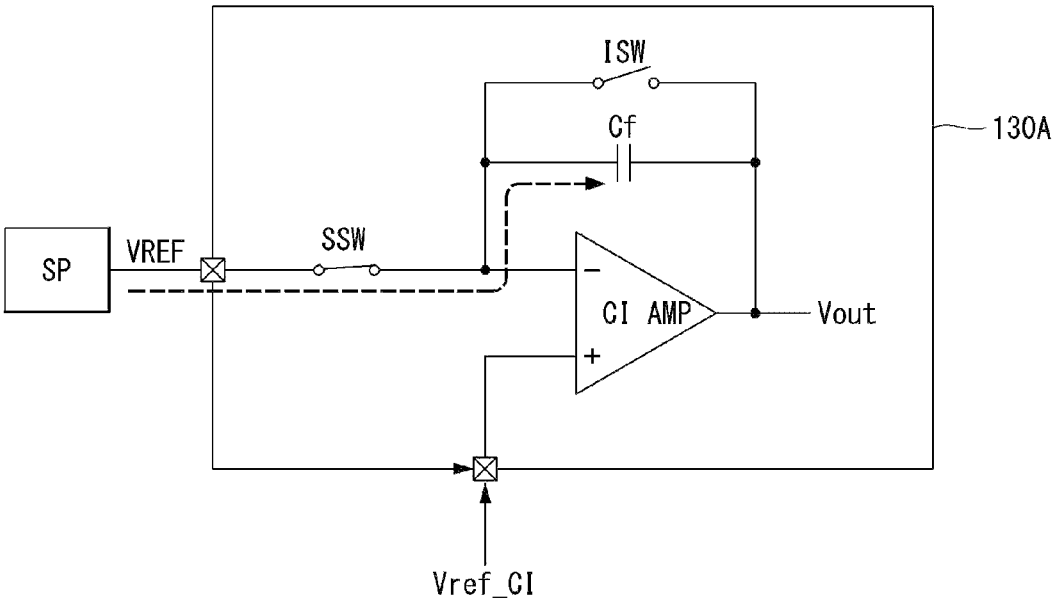
FIGS. 8 and 9 are views for explaining a sensing waveform for an ideal operation.
Figure 9:
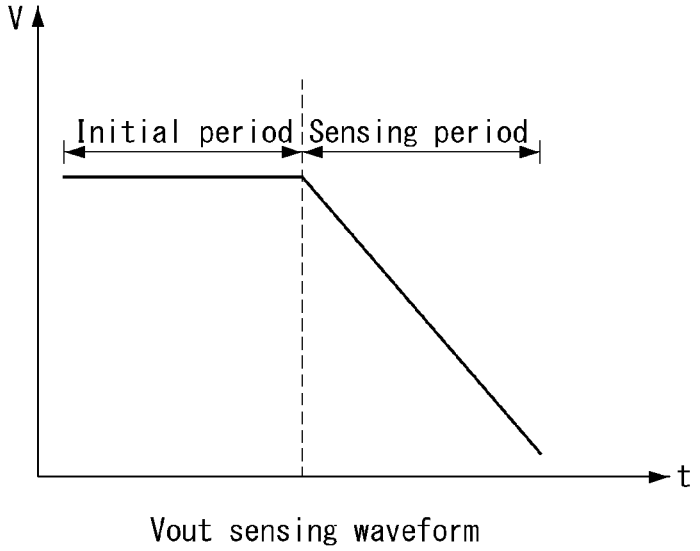
Figure 10:
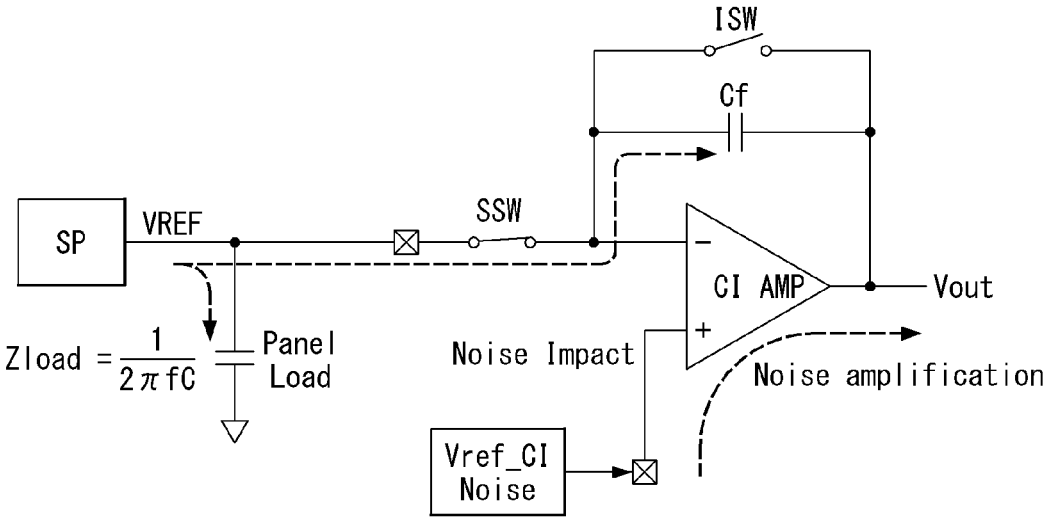
FIGS. 10 and 11 are views for explaining a sensing waveform with a noise component.
Figure 11:
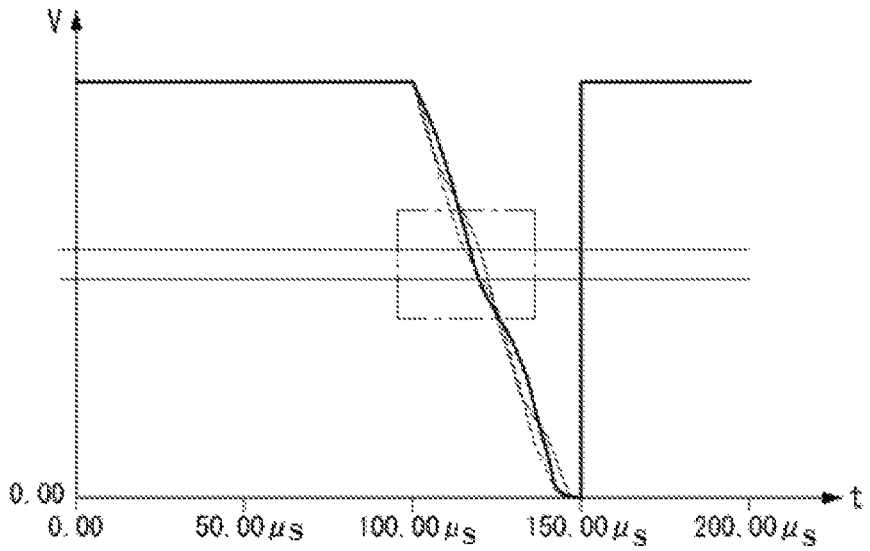
Figure 11:
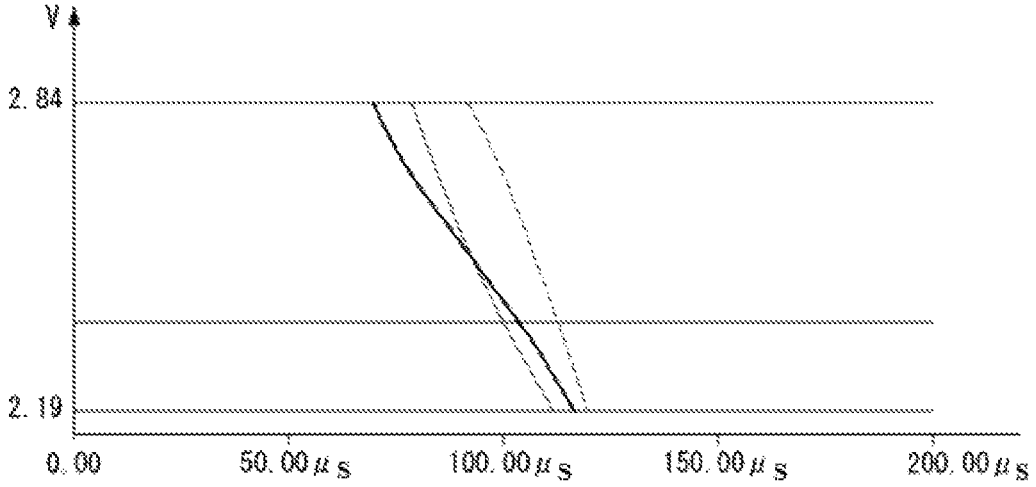

FIG. 6 is a view showing how data drivers and a power supply part are configured according to a test example. FIG. 7 is a view showing some of the components included in a first data driver. FIGS. 8 and 9 are views for explaining a sensing waveform for an ideal operation. FIGS. 10 and 11 are views for explaining a sensing waveform with a noise component.

As illustrated in FIG. 6, according to the test example, a power supply part 160 is placed on a control board 161, and data drivers 130A to 130C are individually placed on source boards 131A to 131C.

The first to third data drivers 130A to 130C receive a driving reference voltage Vref_CH and a sensing reference voltage Vref_CI through a common first wiring line VL1 connected to a first output of the power supply part 160 and a common second wiring VL2 connected to a second output thereof. That is, in the test example, the driving reference voltage Vref_CH required for driving and the sensing reference voltage Vref_CI required for sensing are both received from the power supply part 160 located external to the data drivers. The relationship between the levels of the driving reference voltage Vref_CH and sensing reference voltage Vref_CI is Vref_CH<Vref_CI.

Some of the circuits configured within the data driver 130A will be described below with reference to the following FIG. 7. For the second and third data drivers 130B and 130C, refer to the description of FIG. 7.

As illustrated in FIG. 7, the first data driver 130A according to the test example comprises a current integration circuit part CI AMP, Cf, and ISW and various switches SSW, DSW, and SAM. The first data driver 130A performs driving (voltage charging) and sensing based on a driving reference voltage Vref_CH and sensing reference voltage Vref_CI output from the power supply part.

The first data driver 130A may turn on a driving switch DSW and output an externally supplied driving reference voltage Vref_CH. When sensing is completed, the first data driver 130A may turn on a reset switch ISW and reset an integrating capacitor Cf of the current integration circuit part CI AMP, Cf, and ISW.

As illustrated in FIG. 8, the first data driver 130A according to the test example turns on a sensing switch SSW, performs a sensing operation using the current integration circuit part CI AMP, Cf, and ISW, and integrates a sensing result. The first data driver 130A performs current sensing based on a sensing reference voltage Vref_CI, and turns on a sampling switch SAM to sample a sensed current. An ideal voltage change at an output terminal Vout of the current integration circuit part CI AMP, Cf, and ISW is as shown in the following FIG. 9.

During an initial period, a constant voltage is formed at the output terminal Vout of the current integration circuit part CI AMP, Cf, and ISW. During a sensing period, a sensing voltage that linearly (non-linearly) decreases with time (t) is formed at the output terminal Vout of the current integration circuit part CI AMP, Cf, and ISW.

However, as explained above, all the data drivers, including the first data driver 130A, receive the driving reference voltage Vref_CH and the sensing reference voltage Vref CI from the power supply part placed externally.

Due to this, the voltage at the output terminal Vout of the current integration circuit part CI AMP, Cf, and ISW is affected by noise, as shown in the following FIGS. 10 and 11. As a result, during the sensing period, a voltage that decreases in an undesired (or abnormal) fashion, rather than a voltage that constantly decreases in a linear (or non-linear) fashion with time (t), is formed at the output terminal Vout of the current integration circuit part CI AMP, Cf, and ISW. The simulation of FIG. 11 shows that, when a noise of 40 mV is generated at 50 kHz, a variation of about 290 mV occurs between sensing data.

This problem occurs mainly for the following two reasons: (1) the sensing reference voltage is affected by noise and the corresponding noise component is applied to the output terminal Vout of the current integration circuit part CI AMP, Cf, and ISW; and (2) the sensing reference voltage is amplified and applied to the output terminal Vout of the current integration circuit part CI AMP, Cf, and ISW.

Such a noise component added to the sensing reference voltage may reduce sensing accuracy, thus leading to more errors, lower accuracy, lower uniformity, etc. in compensating for device characteristics.

First Exemplary Embodiment

Figure 12:
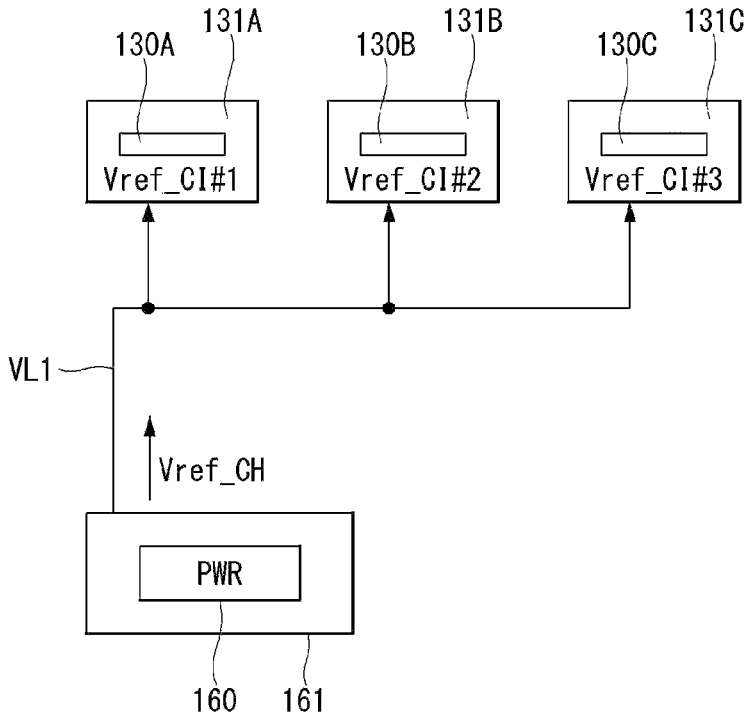
FIG. 12 is a view showing how data drivers and a power supply part are configured according to a first exemplary embodiment of the present disclosure.
Figure 13:
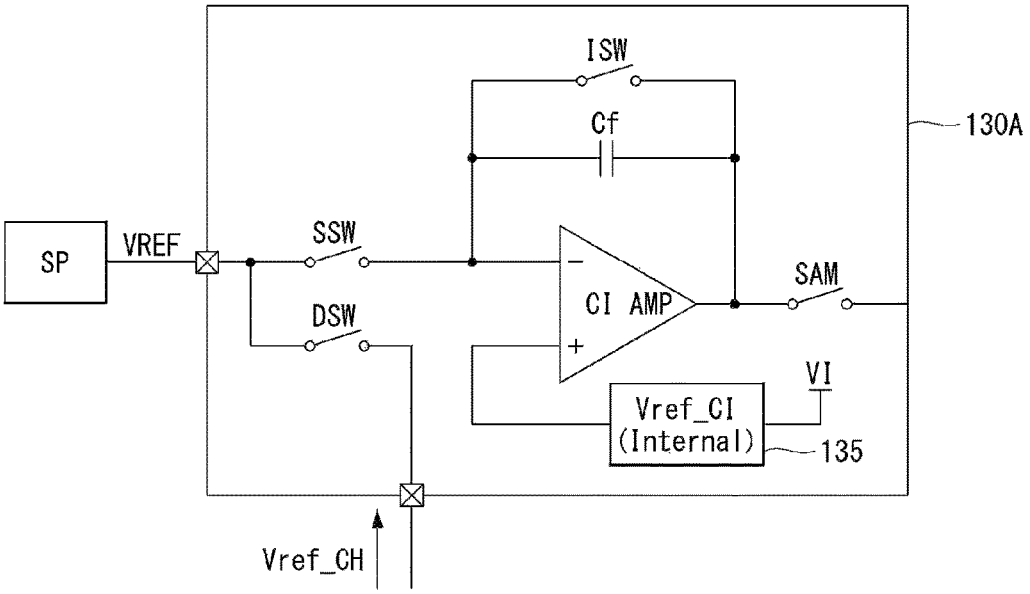
FIG. 13 is a view showing some of the components included in a first data driver.
Figure 14:
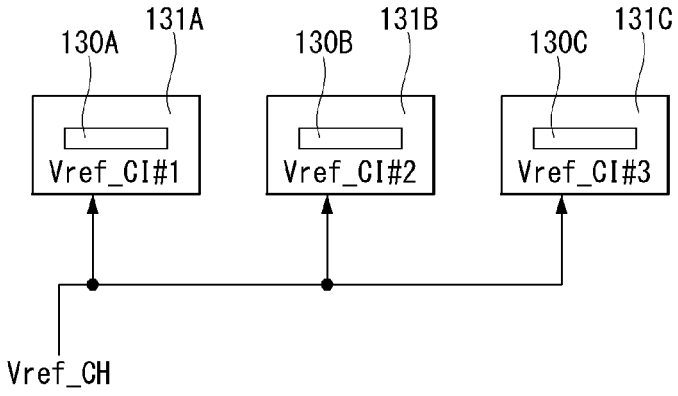
FIG. 14 is a view showing variations in sensing reference voltage before correction.
Figure 14:
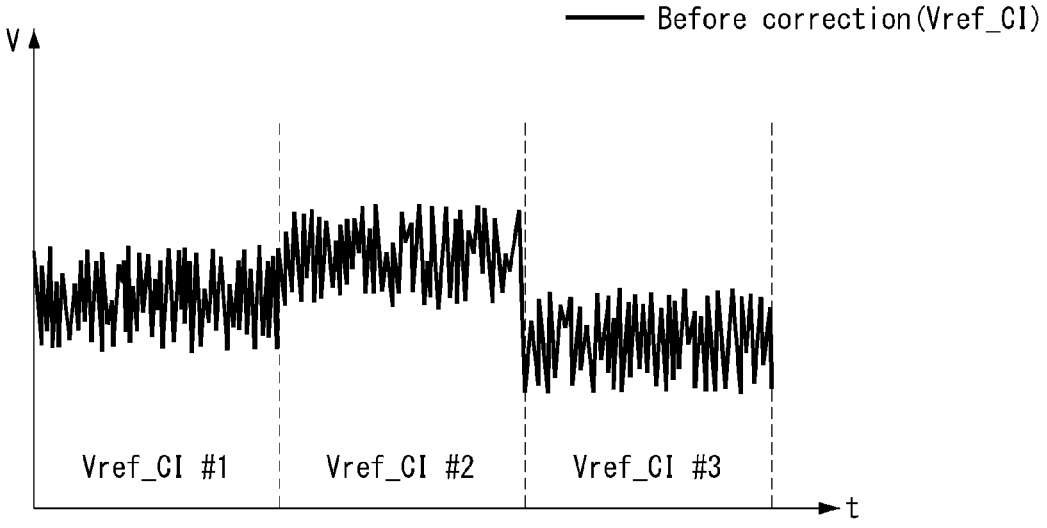

FIG. 12 is a view showing how data drivers and a power supply part are configured according to a first exemplary embodiment of the present disclosure. FIG. 13 is a view showing some of the components included in a first data driver. FIG. 14 is a view showing variations in sensing reference voltage before correction.

As illustrated in FIG. 12, according to the exemplary embodiment of the present disclosure, a power supply part 160 is placed on a control board 161, and data drivers 130A to 130C are individually placed on source boards 131A to 131C.

The first to third data drivers 130A to 130C receive a driving reference voltage Vref_CH through a common first wiring line VL1 connected to a first output of the power supply part 160. The first to third data drivers 130A to 130C generate sensing reference voltages Vref_CI#1 to Vref_CI#3, respectively, based on their internal power source. That is, in the first exemplary embodiment, only the driving reference voltage Vref_CH required for driving is received from the power supply part 160 located external to the data drivers. The relationship between the levels of the driving reference voltage Vref_CH and sensing reference voltage Vref_CI is Vref_CH<Vref_CI.

Some of the circuits configured within the data driver 130A will be described below with reference to the following FIG. 13. For the second and third data drivers 130B and 130C, refer to the description of FIG. 13.

As illustrated in FIG. 13, the first data driver 130A according to the first exemplary embodiment comprises a current integration circuit part CI AMP, Cf, and ISW, various switches SSW, DSW, and SAM, and a voltage generator 135. The various switches SSW, DSW, and SAM are components included in a sensing circuit part.

The first data driver 130A performs driving (voltage charging) and sensing based on a driving reference voltage Vref_CH output from the power supply part and a sensing reference voltage Vref_CI generated based on an internal power source VI.

The voltage generator 135 generates a sensing reference voltage Vref_CI based on the internal power source VI. The voltage generator 135 may be implemented as a buck converter that steps down voltage from the internal power source VI or a boost converter that steps up voltage from the internal power source VI. The internal power source VI may be selected from one of power sources (e.g., VCC, VDD, HVDD, etc.) for driving internal devices in the first data driver 130A.

The first data driver 130A may turn on a driving switch DSW and output an externally supplied driving reference voltage Vref_CH. The first data driver 130A turns on a sensing switch SSW and performs a sensing operation using the current integration circuit part CI AMP, Cf, and ISW. The first data driver 130A performs current sensing based on a sensing reference voltage Vref_CI, and turns on a sampling switch SAM to sample a sensed current. When sensing is completed, the first data driver 130A may turn on a reset switch ISW and reset an integrating capacitor Cf of the current integration circuit part CI AMP, Cf, and ISW.

As illustrated in (a) of FIG. 14, the first to third data drivers 130A to 130C according to the first exemplary embodiment generate sensing reference voltages Vref_CI#1 to Vref_CI#3, respectively, based on their internal power source.

If the internal power sources included in the first to third data drivers 130A to 130C or voltage generation blocks for generating sensing reference voltages based on the internal power sources produce an ideal output, the sensing reference voltages output from the internal power sources or the voltage generation blocks have the same or similar level.

On the other hand, if the internal power sources included in the first to third data drivers 130A to 130C or the voltage generation blocks for generating sensing reference voltages based on the internal power sources do not produce an ideal output, voltage variations may occur as shown in (b) of FIG. 14. If there are variations in sensing reference voltage between the first to third data drivers 130A to 130C, display defects such as block dimming (a decrease in brightness that appears in the shape of a block).

Although (b) of FIG. 14 illustrates an example in which variations occur between the sensing reference voltages Vref_CI#1 to Vref_CI#3 generated by the first to third data drivers 130A to 130C, based on the following relationship: second sensing reference voltage Vref_CI#2>first sensing reference voltage Vref_CI#1>third sensing reference voltage Vref_CI#3, this is merely an illustration.

The sensing reference voltages Vref_CI#1 to Vref_CI#3 generated by the first to third data drivers 130A to 130C may have the problem shown in (b) of FIG. 14 because there may be voltage variations between the internal power sources or between the voltage generators that generate voltages based on the internal power sources.

Below, a second exemplary embodiment for solving the problem of voltage variations expected in the first exemplary embodiment will be described. Since the second exemplary embodiment is based on the first exemplary embodiment, only the circuit configured within the first data driver 130A will be described. For the second and third data drivers 130B and 130C, refer to the description of the second exemplary embodiment.

Second Exemplary Embodiment

Figure 15:
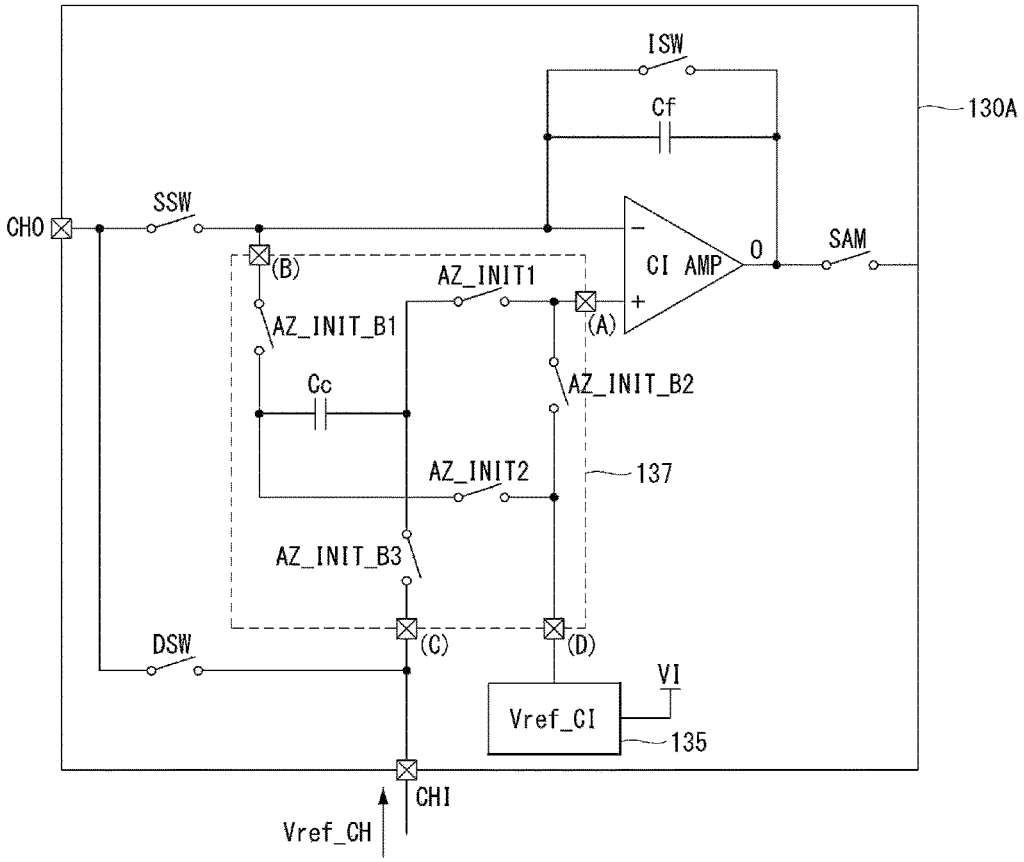
FIG. 15 is a detailed diagram of an offset correction part according to a second exemplary embodiment of the present disclosure.
Figure 16:
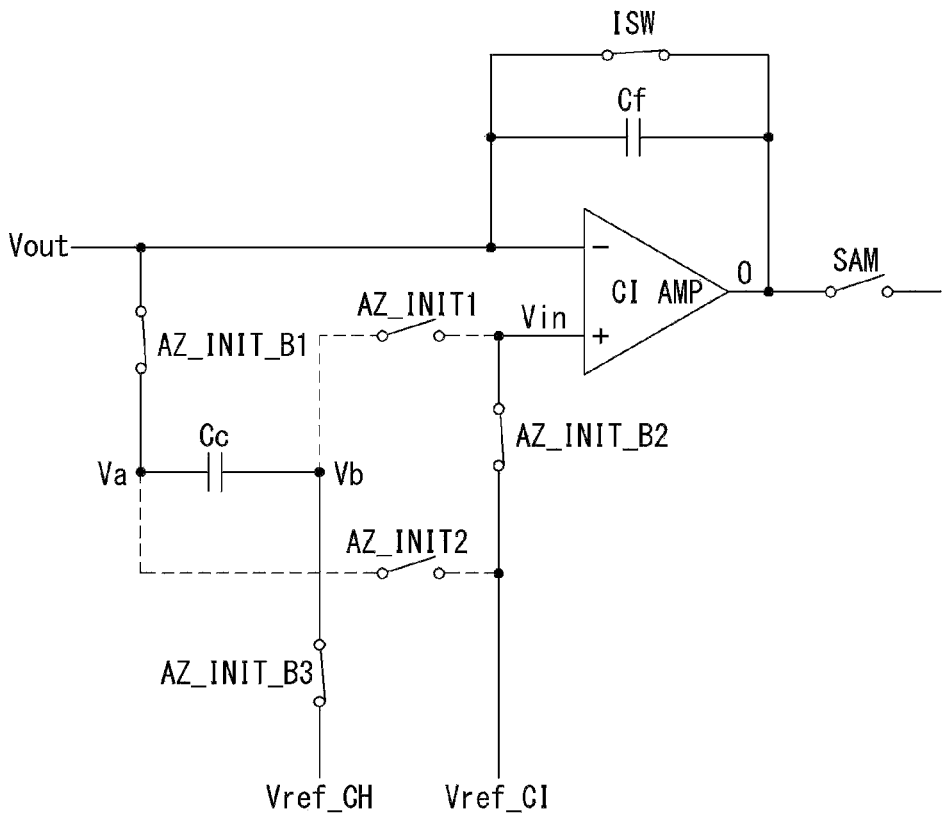
FIGS. 16 and 17 are views for explaining an operation of the offset correction part.
Figure 17:
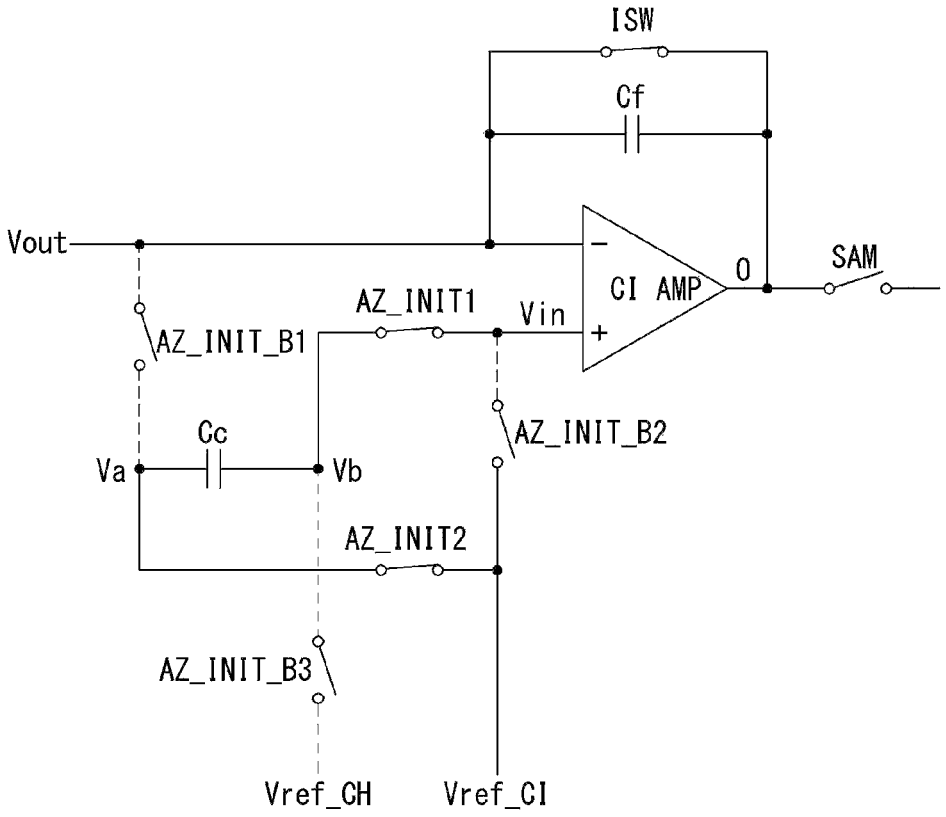
Figure 18:
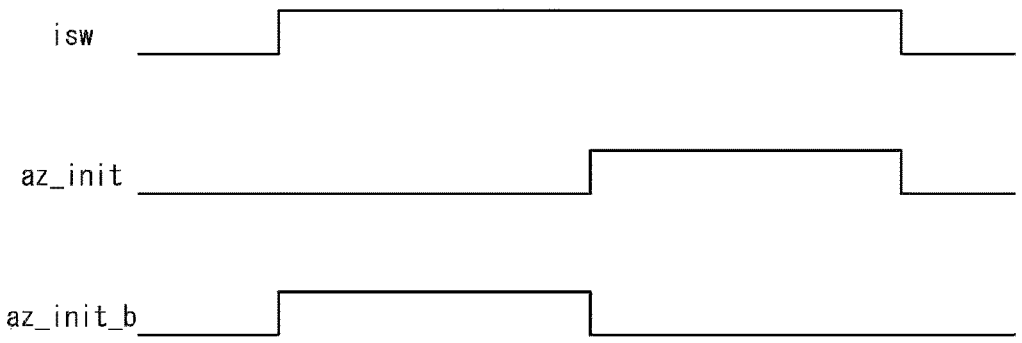
FIG. 18 is a view of driving waveforms of the offset correction part.
Figure 19:
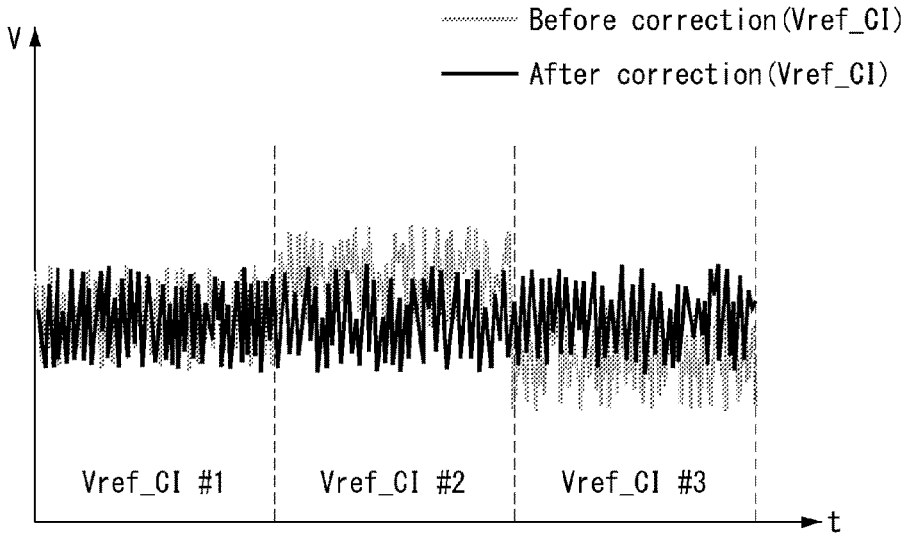
FIG. 19 shows waveform charts for making comparisons between before and after an offset correction and between the test example and the second exemplary embodiment.
Figure 19:
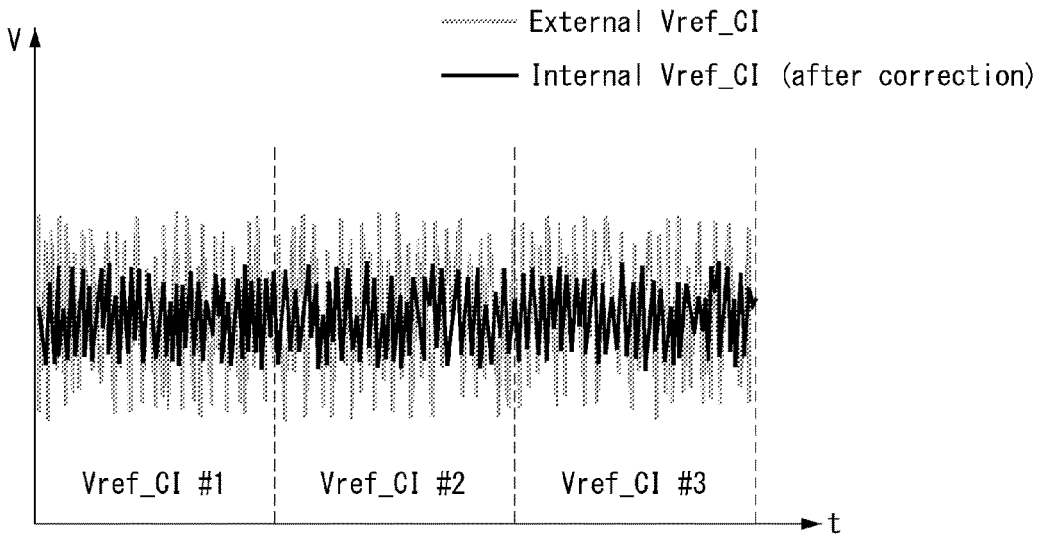
Figure 20:
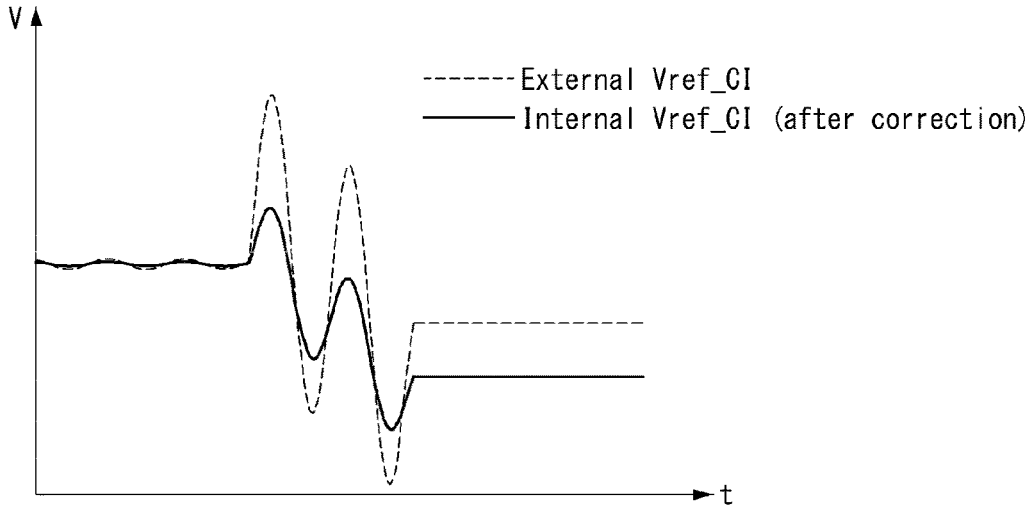
FIG. 20 is a simulation waveform chart for explaining improvements made by the second exemplary embodiment of the present disclosure.
Figure 21:
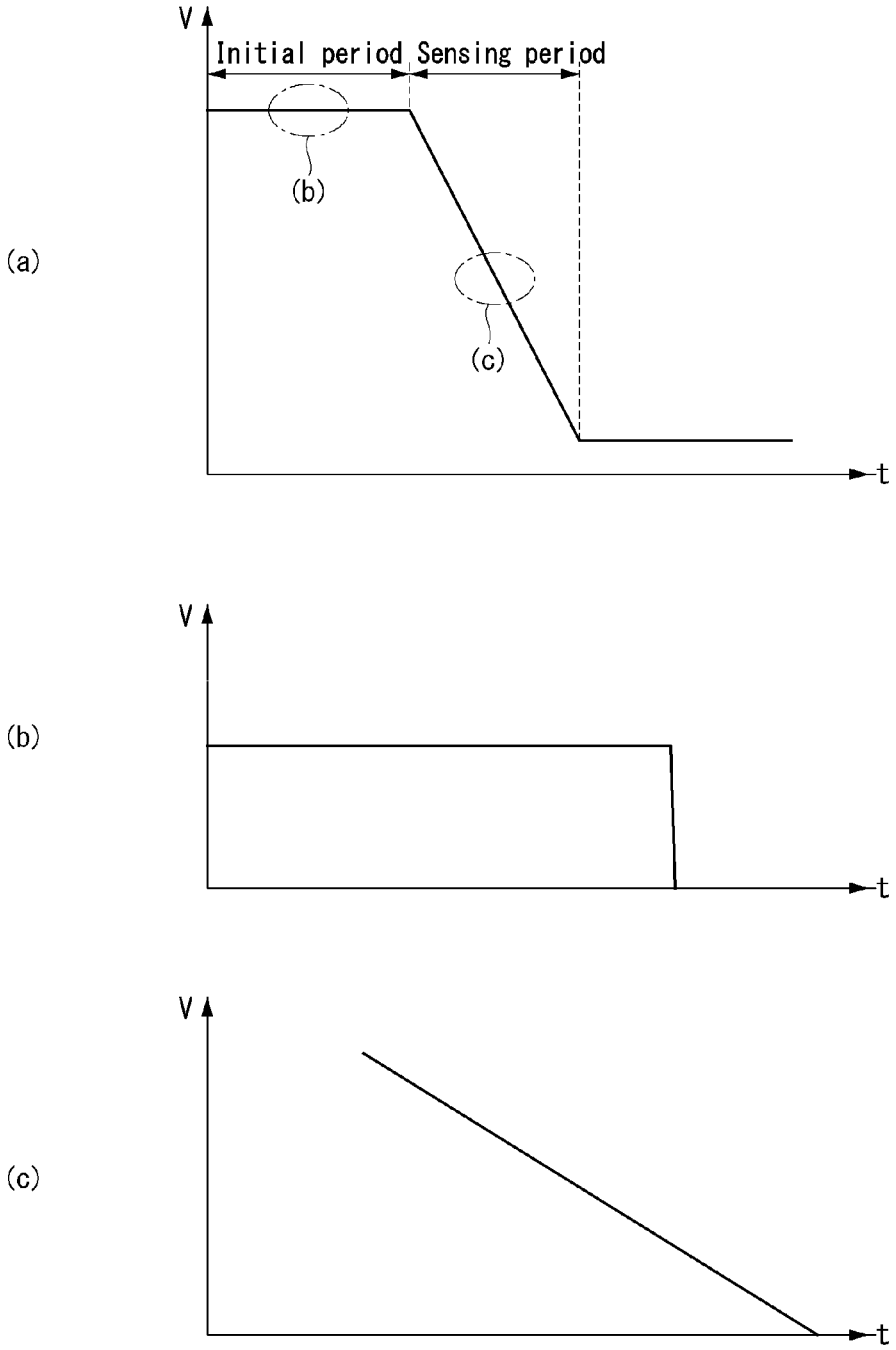
FIG. 21 is a view for explaining sensing waveforms in a sensing operation according to the second exemplary embodiment of the present disclosure.

FIG. 15 is a detailed diagram of an offset correction part according to a second exemplary embodiment of the present disclosure. FIGS. 16 and 17 are views for explaining an operation of the offset correction part. FIG. 18 is a view of driving waveforms of the offset correction part. FIG. 19 shows waveform charts for making comparisons between before and after an offset correction and between the test example and the second exemplary embodiment. FIG. 20 is a simulation waveform chart for explaining improvements made by the second exemplary embodiment of the present disclosure. FIG. 21 is a view for explaining sensing waveforms in a sensing operation according to the second exemplary embodiment of the present disclosure.

As illustrated in FIG. 15, the first data driver 130A according to the second exemplary embodiment comprises a current integration circuit part CI AMP, Cf, and ISW, various switches SSW, DSW, and SAM, a voltage generator 135, and an offset correction part 137. The various switches SSW, DSW, and SAM are components included in a sensing circuit part.

The first data driver 130A performs driving (voltage charging) and sensing based on a driving reference voltage Vref_CH output from the power supply part and a sensing reference voltage Vref_CI generated based on an internal power source VI.

The first data driver 130A may turn on a driving switch DSW and output an externally supplied driving reference voltage Vref_CH. The first data driver 130A turns on a sensing switch SSW and performs a sensing operation using the current integration circuit part CI AMP, Cf, and ISW. The first data driver 130A performs current sensing based on a sensing reference voltage Vref_CI, and turns on a sampling switch SAM to sample a sensed current. When sensing is completed, the first data driver 130A may turn on a reset switch ISW and reset an integrating capacitor Cf of the current integration circuit part CI AMP, Cf, and ISW.

The voltage generator 135 generates a sensing reference voltage Vref_CI based on the internal power source VI. The voltage generator 135 may be implemented as a buck converter that steps down voltage from the internal power source VI or a boost converter that steps up voltage from the internal power source VI. The internal power source VI may be selected from one of power sources (e.g., VCC, VDD, HVDD, etc.) for driving internal devices in the first data driver 130A.

The current integration circuit part CI AMP, Cf, and ISW comprises an amp circuit CI AMP, an integrating capacitor Cf, and a reset switch ISW. A first terminal (+) of the amp circuit CI AMP is connected to a first terminal A of the offset correction part 137. A second terminal (−) of the amp circuit CI AMP is connected to the other end of the sensing switch SSW. An output terminal O of the amp circuit CI AMP is connected to one end of the sampling switch SAM. One end of the integrating capacitor Cf is connected to the second terminal (−) of the amp circuit CI AMP, and the other end is connected to the output terminal O of the amp circuit CI AMP. One end of the reset switch ISW is connected to the second terminal (−) of the amp circuit CI AMP, and the other end is connected to the output terminal O of the amp circuit CI AMP.

One end of the sensing switch SSW is connected to an output channel CHO of the first data driver 130A, and the other end is connected to the second terminal (−) of the amp circuit CI AMP and a second terminal B of the offset correction part 137. One end of the driving switch DSW is connected to the output channel CHO of the first data driver 130A, and the other end is connected to an input channel CHI of the first data driver 130A and a third terminal C of the offset correction part 137. One end of the sampling switch SAM is connected to the output terminal O of the amp circuit CI AMP, and the other end is connected to a sensing circuit (or AD conversion circuit or the like, not shown).

The offset correction part 137, along with the current integration circuit part CI AMP, Cf, and ISW, serves to cancel out or correct for variations in sensing reference voltage Vref_CI by using an externally supplied driving reference voltage Vref_CH as a reference.

The offset correction part 137 comprises switches AZ_INIT_B1 to AZ_INIT_B3 and AZ_INIT1 and AZ_INIT2 and an offset cancellation capacitor Cc. The switches AZ_INIT_B1 to AZ_INIT_B3 and AZ_INIT1 and AZ_INIT2 comprise a first switch group AZ_INIT_B1 to AZ_INIT_B3 that performs a switching operation for storing an input voltage and an offset for the amp circuit CI AMP in the offset cancellation capacitor Cc, and a second switch group AZ_INIT1 and AZ_INIT2 that performs a switching operation for applying an input voltage and an offset for the amp circuit CI AMP to the sensing reference voltage Vref_CI.

The switches included in the first switch group AZ_INIT_B1 to AZ_INIT_B3 simultaneously turn on or off in response to a first control signal. The switches included in the second switch group AZ_INIT1 and AZ_INIT2 simultaneously turn on or off in response to a second control signal. When the first switch group AZ_INIT_B1 to AZ_INIT_B3 is turned on, the second switch group AZ_INIT1 and AZ_INIT2 is turned off. The first switch group AZ_INIT_B1 to AZ_INIT_B3 and the second switch group AZ_INIT1 and AZ_INIT2 are driven in opposite manners.

The first switch group AZ_INITI_B1 to AZ_INIT_B3 comprises a 1-1 switch AZ_INIT_B1, a 1-2 switch AZ_INIT_B2, and a 1-3 switch AZ_INIT_B3.

The second switch group AZ_INIT1 and AZ_INIT2 comprises a 2-1 switch AZ_INIT1 and a 2-2 switch AZ_INIT2.

One end of the 1-1 switch AZ_INIT_B1 is connected to the second terminal B of the offset correction part 137, and the other end is connected to one end of the offset cancellation capacitor Cc and one end of the 2-2 switch AZ_INIT2. One end of the 1-1 switch AZ_INIT_B1 is connected to the other end of the sensing switch SSW through the second terminal B of the offset correction part 137.

One end of the 1-2 switch AZ_INIT_B2 is connected to the other end of the 2-1 switch AZ_INIT1 and the first terminal A of the offset correction part 137, and the other end is connected to the other end of the 2-2 switch AZ_INIT2 and a fourth terminal D of the offset correction part 137. The other end of the 1-2 switch AZ_INIT_B2 is connected to an output of the voltage generator 135 through the fourth terminal D of the offset correction part 137.

One end of the 1-3 switch AZ_INIT_B3 is connected to one end of the 2-1 switch AZ_INIT1 and the other end of the offset cancellation capacitor Cc, and the other end is connected to the third terminal C of the offset correction part 137. The other end of the 1-3 switch AZ_INIT_B3 is connected to the input channel CHI of the first data driver 130A through the third terminal C of the offset correction part 137.

One end of the 2-1 switch AZ_INIT1 is connected to one end of the 1-3 switch AZ_INIT_B3 and the other end of the offset cancellation capacitor Cc, and the other end is connected to the first terminal A of the offset correction part 137 and one end of the 1-2 switch AZ_INIT_B2. The other end of the 2-1 switch AZ_INIT1 is connected to the first terminal (+) of the amp circuit CI AMP through the first terminal A of the offset correction part 137.

One end of the 2-2 switch AZ_INIT2 is connected to one end of the offset cancellation capacitor Cc and the other end of the 1-1 switch AZ_INIT_B1, and the other end is connected to the fourth terminal D of the offset correction part 137 and the other end of the 1-2 switch AZ_INIT_B2. The other end of the 2-2 switch AZ_INIT2 is connected to the output of the voltage generator 135 through the fourth terminal D of the offset correction part 137.

An operation of the offset correction part according to the second exemplary embodiment of the present disclosure will be described below with reference to the following FIGS. 16 to 18. In FIG. 18, isw is a reset signal for controlling the reset switch ISW, az_init denotes a second control signal for controlling the second switch group AZ_INIT1 and AZ_INIT2, and az_init_b denotes a first control signal for controlling the first switch group AZ_INITI_B1 to AZ_INIT_B3.

FIG. 18 depicts the first and second control signals separately. However, the first and second control signals may be configured practically as one signal since the first switch group AZ_INITI_B1 to AZ_INIT_B3 and the second switch group AZ_INIT1 and AZ_INIT2 are driven in opposite manners. That is, the first switch group AZ_INITI_B1 to AZ_INIT_B3 may consist of n-type switches, and the second switch group AZ_INIT1 and AZ_INIT2 may consist of p-type switches.

<Offset Storage Operation>

The first switch group AZ_INITI_B1 to AZ_INIT_B3 and the second switch group AZ_INIT1 and AZ_INIT2 are driven in opposite manners during a first period in which the reset switch ISW is kept turned on by a reset signal isw. During the first period, the first switch group AZ_INITI_B1 to AZ_INIT_B3 turns on. In this case, the second switch group AZ_INIT1 and AZ_INIT2 turns off. A description will be given below about how voltage changes at each stage in an offset storage operation.

A sensing reference voltage Vref_CI and an offset voltage Voffset_power for the sensing reference voltage Vref_CI are applied as an input voltage VIN to the first terminal (+) of the amp circuit CI AMP. The input voltage VIN is represented by the following equation: VIN=Vref_CI+Voffset_power.

A sensing reference voltage Vref_CI, an offset voltage Voffset_power for the sensing reference voltage Vref_CI, and an amp offset voltage Voffset_AMP are applied as an output voltage Vout to the second terminal (−) of the amp circuit CI AMP. The output voltage Vout is represented by the following equation: Vout=Vref_CI+Voffset power+Voffset_AMP.

Due to operations of the first switch group AZ_INIT_BI to AZ_INIT_B3 and the amp circuit CI AMP, the following voltage is applied to two ends of the offset cancellation capacitor Cc. The voltage applied to a first terminal Va of the offset cancellation capacitor Cc is represented by the following equation: Va=Vref_CI+Voffset_power+Voffset_AMP. The voltage applied to a second terminal Vb of the offset cancellation capacitor Cc is represented by the following equation: Vb=Vref_CH.

In this way, during the first period, the amp circuit CI AMP operates as a buffer, and a differential voltage between the two ends is stored in the offset cancellation capacitor Cc by a switching operation of the offset correction part 137.

<Offset Application Operation>

The second switch group AZ_INIT1 and AZ_INIT2 and the first switch group AZ_INITI_B1 to AZ_INIT_B3 are driven in opposite manners during a second period in which the reset switch ISW is kept turned on by a reset signal isw. During the second period, the second switch group AZ_INIT1 and AZ_INIT2 turns on. In this case, the first switch group AZ_INITI_B1 to AZ_INIT_B3 turns off. A description will be given below about how voltage changes at each stage in an offset application operation.

A value obtained by subtracting an amp offset voltage Voffset AMP from a driving reference voltage Vref_CH is applied as an input voltage VIN to the first terminal (+) of the amp circuit CI AMP. The input voltage VIN is represented by the following equation: VIN=Vref_CH−Voffset AMP.

A driving reference voltage Vref_CH is applied as an output voltage Vout to the second terminal (−) of the amp circuit CI AMP. The output voltage Vout is represented by the following equation: Vout=Vref_CH.

Due to operations of the second switch group AZ_INIT1 and AZ_INIT2 and the amp circuit CI AMP, the following voltage is applied to two ends of the offset cancellation capacitor Cc. The voltage applied to a first terminal Va of the offset cancellation capacitor Cc is represented by the following equation: Va=Vref_CH+Voffset_power. The voltage applied to a second terminal Vb of the offset cancellation capacitor Cc is represented by the following equation: Vb=Vref_CH−Voffset AMP.

In this way, during the second period, the voltage levels of the sensing reference voltage Vref_CI and amp circuit CI AMP are controlled and output by a switching operation of the offset correction part 137.

According to the above description, in the second exemplary embodiment of the present disclosure, an externally supplied, common driving reference voltage is used as a reference in order to cancel out variations between sensing reference voltages Vref_CI generated within the data drivers.

As illustrated in (a) of FIG. 19, there are significant variations between first to third sensing reference voltages Vref_CI#1 to Vref_CI#3 before correction due to device characteristics. However, as can be seen from the first to third sensing reference voltages Vref_CI#1 to Vref_CI#3 after correction, the voltage variations may be significantly reduced by the offset correction parts 137 provided within the first to third data drivers.

As illustrated in (b) of FIG. 19, when an externally supplied, common sensing reference voltage Vref_CI is used, significant fluctuations in voltage level arise from noise. However, noise components may be reduced further than with external voltage by using the first to third sensing reference voltages Vref_CI#1 to Vref_CI#3 after correction as in the second exemplary embodiment.

As can be seen in FIGS. 14 and 20, an externally supplied, common sensing reference voltage (external Vref_CI) is susceptible to noise, and the resulting ripple has a greater amplitude than internal Vref_CI. In contrast, a sensing reference voltage (internal Vref_CI) according to the second exemplary embodiment is resistant to noise, and the resulting ripple has a smaller amplitude than external Vref_CI.

In the second exemplary embodiment, a normal, noise-resistant voltage is formed at the output terminal Vout of the current integration circuit part CI AMP, Cf, and ISW, which decreases in a linear (or non-linear) fashion with time (t), as shown in FIG. 21.

Therefore, in the second exemplary embodiment, it is possible to achieve high noise resistance and to prevent sensing errors, which may arise from internal power source variations in the data drivers, and more significant errors caused by current changes at the driving transistors due to the internal power source variations.

As stated above, the present disclosure has the advantage of generating a sensing reference voltage within a data driver and minimizing noise (achieving high noise resistance). Another advantage of the present disclosure is to improve voltage accuracy and sensing accuracy by correcting for voltage variations between sensing reference voltages generated by data drivers. Yet another advantage of the present disclosure is that noise in sensing reference voltage can be reduced, thus leading to higher compensation accuracy in performing compensations such as compensating for device characteristics or adjusting brightness level.

What is claimed is:

1. A display device comprising:

a display panel that displays an image and has a data line and a sensing line;

a data driver that drives the display panel; and a power supply part that delivers a driving reference voltage through a wiring line connected to the data driver, wherein the data driver supplies a data signal to the data line, supplies the driving reference voltage through the sensing line, senses the sensing line based on an internally generated sensing reference voltage, and integrates a sensing result wherein the data driver comprises:

an integration circuit part for sensing the sensing line based on the sensing reference voltage; and an offset correction part that corrects for variations in the sensing reference voltage, along with the integration circuit part, by using the driving reference voltage as a reference, wherein the integration circuit part comprises:

an amp circuit, a first terminal of which is connected to a first terminal of the offset correction part;

an integrating capacitor, one end of which is connected to a second terminal of the amp circuit, and another end of which is connected to an output terminal of the amp circuit; and a reset switch, one end of which is connected to the second terminal of the amp circuit, and another end of which is connected to the output terminal of the amp circuit.

2. The display device of claim 1, wherein the data driver comprises a voltage generator that generates the sensing reference voltage based on an internal power source.

3. The display device of claim 1, wherein the offset correction part comprises:

an offset cancellation capacitor that stores a voltage for offset cancellation;

a first switch group that performs a switching operation for storing an external input voltage and an offset for the amp circuit in the offset cancellation capacitor; and a second switch group that performs a switching operation for applying the offset to the sensing reference voltage.

4. The display device of claim 3, wherein the first switch group comprises:

a 1-1 switch, one end of which is connected to a second terminal of the offset correction part, and another end of which is connected to one end of the offset cancellation capacitor;

a 1-2 switch, one end of which is connected to the first terminal of the offset correction part, and another end of which is connected to a fourth terminal of the offset correction part; and a 1-3 switch, one end of which is connected to another end of the offset cancellation capacitor, and another end of which is connected to a third terminal of the offset correction part.

5. The display device of claim 4, wherein the second switch group comprises:

a 2-1 switch, one end of which is connected to the one end of the 1-3 switch and the another end of the offset cancellation capacitor, and another end of which is connected to the first terminal of the offset correction part and the one end of the 1-2 switch; and a 2-2 switch, one end of which is connected to the one end of the offset cancellation capacitor and another end of the 1-1 switch, and another end of which is connected to the another end of the 1-2 switch.

6. The display device of claim 3, wherein, when the reset switch of the integration circuit part is turned on, the first switch group and the second switch group are driven in opposite manners.

7. A data driver comprising:

an integration circuit part that applies an externally supplied driving reference voltage to an external sensing line, senses the external sensing line based on an internally generated sensing reference voltage, and integrates a sensing result; and an offset correction part that corrects for variations in the sensing reference voltage, along with the integration circuit part, by using the driving reference voltage as a reference, wherein the integration circuit part comprises:

an amp circuit, a first terminal of which is connected to a first terminal of the offset correction part;

an integrating capacitor, one end of which is connected to a second terminal of the amp circuit, and another end of which is connected to an output terminal of the amp circuit; and a reset switch, one end of which is connected to the second terminal of the amp circuit, and another end of which is connected to the output terminal of the amp circuit.

8. The data driver of claim 7, wherein the offset correction part comprises:

an offset cancellation capacitor that stores a voltage for offset cancellation;

a first switch group that performs a switching operation for storing an external input voltage and an offset for the amp circuit in the offset cancellation capacitor; and a second switch group that performs a switching operation for applying the offset to the sensing reference voltage.

9. The data driver of claim 8, wherein the first switch group comprises:

a 1-1 switch, one end of which is connected to a second terminal of the offset correction part, and another end of which is connected to one end of the offset cancellation capacitor;

a 1-2 switch, one end of which is connected to the first terminal of the offset correction part, and another end of which is connected to a fourth terminal of the offset correction part; and a 1-3 switch, one end of which is connected to another end of the offset cancellation capacitor, and another end of which is connected to a third terminal of the offset correction part.

10. The data driver of claim 9, wherein the second switch group comprises:

a 2-1 switch, one end of which is connected to the one end of the 1-3 switch and the another end of the offset cancellation capacitor, and another end of which is connected to the first terminal of the offset correction part and the one end of the 1-2 switch; and a 2-2 switch, one end of which is connected to the one end of the offset cancellation capacitor and the another end of the 1-1 switch, and another end of which is connected to the another end of the 1-2 switch.

11. The data driver of claim 8, wherein, when the reset switch of the integration circuit part is turned on, the first switch group and the second switch group are driven in opposite manners.

* * * * *